US007254914B2

(12) United States Patent
Lund et al.

(10) Patent No.: US 7,254,914 B2
(45) Date of Patent: Aug. 14, 2007

(54) HYDROGEN OPERATED RECREATIONAL LAUNCHER

(75) Inventors: Bruce D. Lund, River Forest, IL (US); Michael D. Starrick, Maywood, IL (US)

(73) Assignee: Lund Technologies, LLC, Chicago, IL (US)

( * ) Notice: Subject to any disclaimer, the term of this patent is extended or adjusted under 35 U.S.C. 154(b) by 84 days.

(21) Appl. No.: 11/136,862

(22) Filed: May 25, 2005

(65) Prior Publication Data

US 2006/0266206 A1 Nov. 30, 2006

(51) Int. Cl.
*F41A 1/04* (2006.01)
*F41C 27/00* (2006.01)

(52) U.S. Cl. ..... 42/106; 89/7; 124/70; 124/71

(58) Field of Classification Search ..... 42/106; 89/7, 8; 124/65, 70, 71, 73
See application file for complete search history.

(56) References Cited

U.S. PATENT DOCUMENTS 2,965,000 A * 12/1960 Skinner ..... 89/1.7
3,131,597 A * 5/1964 Smith et al. ..... 89/8
3,253,511 A * 5/1966 Zwicky ..... 89/1.814
3,465,638 A * 9/1969 Canning ..... 89/8
3,665,803 A * 5/1972 Forsten et al. ..... 89/7
4,049,367 A * 9/1977 Tominaga et al. ..... 425/77
4,653,380 A * 3/1987 Griffing et al. ..... 89/7
4,938,112 A * 7/1990 Hertzberg et al. ..... 89/7
5,020,439 A * 6/1991 Winter et al. ..... 102/518
5,078,117 A * 1/1992 Cover ..... 124/71
5,485,787 A * 1/1996 Bowcutt et al. ..... 102/374
5,703,322 A * 12/1997 Tidman ..... 102/440
5,831,199 A * 11/1998 McNulty et al. ..... 89/1.11
6,212,988 B1 * 4/2001 Chernyshov et al. ..... 89/7
6,247,995 B1 * 6/2001 Bryan ..... 446/473
6,295,752 B1 * 10/2001 Havlock ..... 42/76.01
6,517,010 B1 * 2/2003 Barykin et al. ..... 239/79
6,532,728 B1 * 3/2003 Goyne et al. ..... 60/204
6,679,155 B1 * 1/2004 Yaschur et al. ..... 89/1.813
6,681,676 B2 * 1/2004 Hayes et al. ..... 89/1.34
2004/0144012 A1 * 7/2004 Adams ..... 42/106

* cited by examiner

*Primary Examiner*—Bret Hayes

(57) ABSTRACT

A hydrogen operated gun for shooting projectiles such as a paint pellet. Hydrogen gas is supplied to a combustion chamber and is combusted by a trigger controlled piezo igniter. The hydrogen may be supplied by a hydrogen generator or by a hydrogen storage container located in the gun housing. Suitable valve mechanisms are provided to control the flow of hydrogen to the combustion chamber and the expelling of exhaust gases from the combustion chamber.

18 Claims, 8 Drawing Sheets

HYDROGEN OPERATED RECREATIONAL LAUNCHER

BACKGROUND OF THE INVENTION

The present invention relates to a recreational launcher such as a gun to propel various kinds of projectiles. There are literally hundreds of devices on the market for shooting bullets, pellets, and paint balls but some have the disadvantage of polluting the air with powder smoke, $C0_2$ or other propellant. There has long been a need for a gun operated by hydrogen that has the desired explosive effect and does not present environmental concerns.

SUMMARY OF THE INVENTION

In accordance with the present invention there is provided a hydrogen operated gun that is simple and easy to use.

The gun can use hydrogen received from a hydrogen storage tank located in the gun housing or use hydrogen generated by the electrolysis of water in a generating chamber located within the gun housing.

Specifically, the hydrogen whether it is internally generated or received from a storage tank is directed to a combustion chamber where it is ignited by a piezo igniter or a glow wire. The explosion in the chamber acts against a piston to compress the air in a forward chamber to drive a paint ball, a pellet, and spherical or other kinds of projectiles. The hydrogen generator is battery powered. In another embodiment, the exploding hydrogen can act directly on the projectile.

Other advantages and features will be apparent from the following drawings and description thereof in which:

FIG. 1 is a cross-sectional view showing the internal components of the hydrogen operated gun using hydrogen from an internal generator that produces hydrogen from the electrolysis of water;

FIG. 2 is a partial cross-sectional view showing the slide valve operating handle positioned for the feeding of hydrogen fuel into the combustion chamber.

FIG. 3 is a partial cross-sectional view similar to FIG. 2 showing the valve components in position to exhaust the gases from the combustion chamber.

FIG. 4 is a partial view showing the slide valve rotated to engage a pin connected to the piston shaft whereby the slide valve is locked in position relative to the piston shaft.

FIG. 5 is a view similar to FIG. 1 in which the hydrogen used in the combustion chamber is received from a hydrogen storage tank located internally of the gun housing;

FIG. 6 is a view similar to FIG. 1 utilizing the hydrogen operated gun to shoot a dart;

FIG. 7 is a view similar to FIG. 1 incorporating a resilient ball holder secured to the gun barrel and a ball retained therein; and FIG. 8 is a view similar to FIG. 1 showing a hydrogen operated gun for shooting a slug-shaped, spherical or pellet-shaped projectile.

DESCRIPTION OF THE DRAWINGS

Referring first to FIG. 1 there is illustrated a recreational launcher 10 in the form of a gun defined by a housing 11 for shooting projectiles such as a paint ball 12.

The paint ball 12 is driven by the explosive charge of ignited hydrogen in a combustion chamber 14. In this embodiment, the hydrogen to be used as a fuel is generated in a generation chamber 16 that liberates hydrogen and oxygen from an aqueous solution by the process of electrolysis. The hydrogen generator is filled by removal of the fill cap 17.

Figure 1:
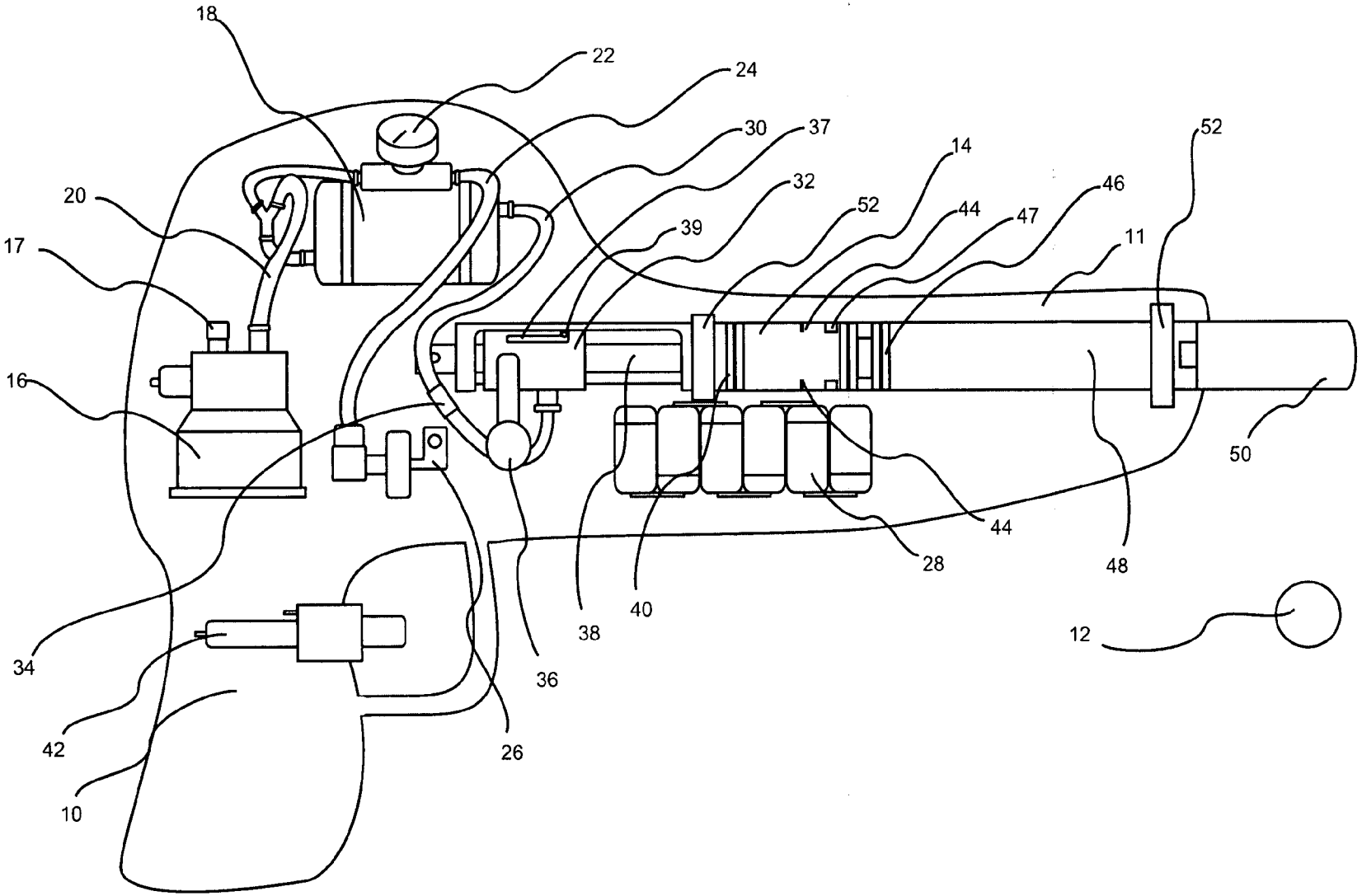

The liberated hydrogen/oxygen mixture is stored in a resilient storage vessel 18 through a transfer tube 20. The fuel stored in the vessel 18 is enough for a number of launches. Also connected to the transfer tube 20 is a gauge 22 (optional) and a pressure sensing transfer hose 24. Hose 24 is connected to pressure switch 26 that controls the hydrogen generation by switching power from batteries 28 to generation chamber 16. When the pressure in vessel 18 falls below a predetermined level, pressure switch 26 closes and electricity is allowed to flow to the generation chamber 16. When sufficient gases have been generated the pressure in vessel 16 rises and the pressure switch 26 opens stopping the flow of electricity to the generation chamber 16. Once sufficient gases are generated then the user can draw gases out of vessel 16 through fuel supply hose 30 to shuttle valve 32. In hose 30, there is provided a check valve 34 that prevents the back flow of pressure from combustion chamber 14.

Figure 4:
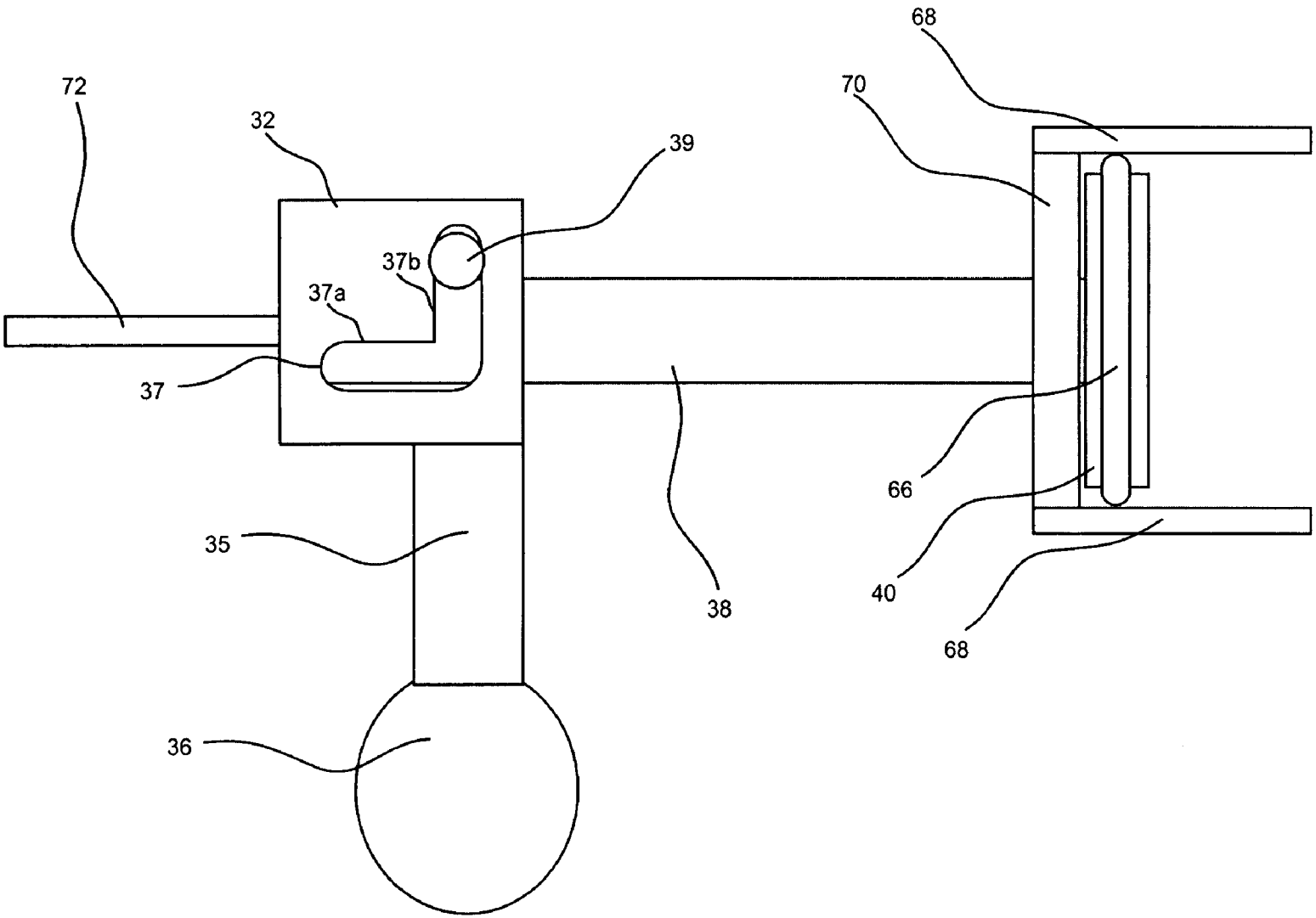

The user operates shuttle valve 32 via knob 36 on handle 35 to allow the combustible gas mixture to flow through hollow piston shaft 38 and primary piston 40. A detailed explanation of how shuttle valve 32 operates will be discussed further with respect to FIG. 2. Generally, after sufficient combustible gases are in combustion chamber 14 shuttle valve 32 is rotated into slot 37*b* as shown in FIG. 4 to block the flow of gases from hydrogen inlet conduit 30. The operator can ignite the gases in combustion chamber 14 by operating piezo igniter 42 in gun trigger area that sends a high voltage impulse to electrodes 44. The subsequent spark in combustion chamber 14 ignites the gas mixture and creates a pressure impulse. Although a spark is used to ignite the gases a glow wire could be employed. The pressure impulse then acts upon secondary piston 46 to compress air in forward chamber 48 which works in conjunction with a holder 50 to launch the projectile which in this case is a paint ball 12.

Also in housing 11 are mounting brackets 52 that connect the various components to the housing 11. Once a projectile has been launched the operator rotates the handle 36 of shuttle valve 32 to where pin 38 is out of slot 37*b* and the handle is free to move forward relative to piston shaft 38 to place passage 58 into communication with exhaust port 56 to exhaust the gases from chamber 14. Specifically, during the forward movement of the shuttle valve after the shuttle valve 32 is unlocked, the shaft pin 39 extending from the shaft 38 is located in the longitudinal portion 37*a* of valve slot 37. The valve 32 can move relative to the shaft 38 between the gas inlet port 60 and exhaust port 56. It is to be noted that after a projectile has been launched due to the ignition of the hydrogen gas in the combustion chamber 14 a vacuum is created in chamber 14 and the secondary piston 46 retracts until it engages piston stops 47. To launch another projectile, the operator moves the shuttle valve forward on shaft 38 to place the gas inlet port 60 into alignment with piston port 58. After the fresh gas fills the combustion chamber, the shuttle valve 32 is rotated to where the pin 39 is in slot 37*b* as shown in FIG. 4 to where the ports 56, 60 are closed off from piston port 58. The launcher is now ready to be fired again to launch another projectile. Although the launcher is shown with a secondary piston 46 in FIGS. 1, 6 and 7, it should be noted that a direct acting configuration is possible with the explosive forces acting directly on the projectile (see FIG. 8).

Figure 2:
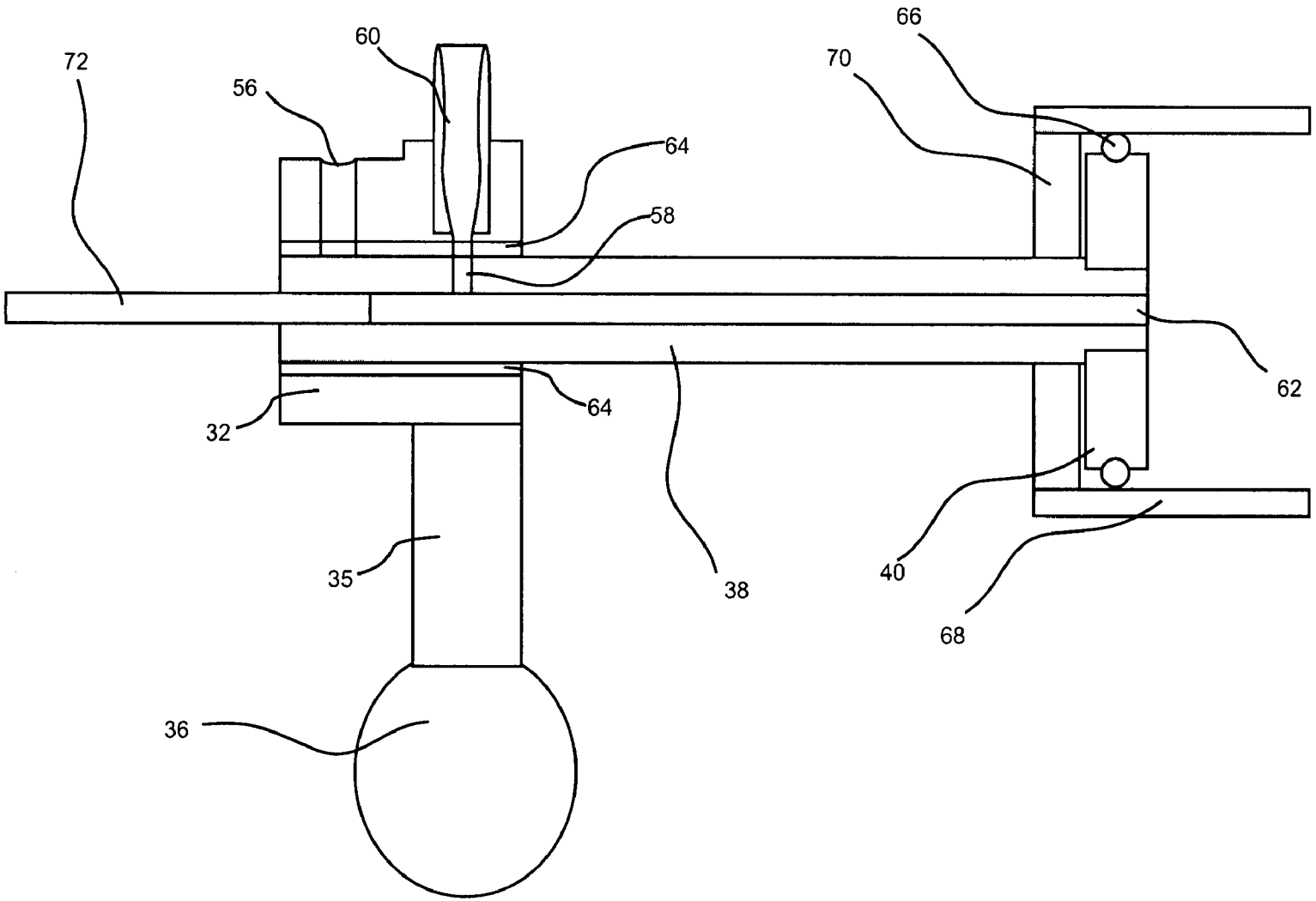

For more details of the valving arrangement see FIG. 2 where a cross sectional view of the shuttle valve assembly 32 is shown. Shuttle valve 32 is in the most rearward position on hollow piston shaft 38 to align gas inlet port 60 with shaft port 58 to allow gases to flow into the combustion chamber 14 through central passage 62. Shuttle valve 32 is sealed against shaft 38 by a flexible sealing member 64 which allows for the flow of gas at the appropriate time but seals valve off 32 when no gas flow is desired. In this position gases have moved into the combustion chamber 14 via the hollow piston shaft 38. The combustion chamber 14 is sealed by an "O" ring 66 in conjunction with primary piston 40 and cylinder wall 68. The piston 40 rearward travel is limited by cylinder cap 70. Hollow piston shaft 38 is sealed opposite primary piston 40 by guide pin 72. Guide pin 72 allows for an adjustable drag to be imposed on shaft 38 to facilitate the effective movement of shuttle valve 32.

Figure 3:
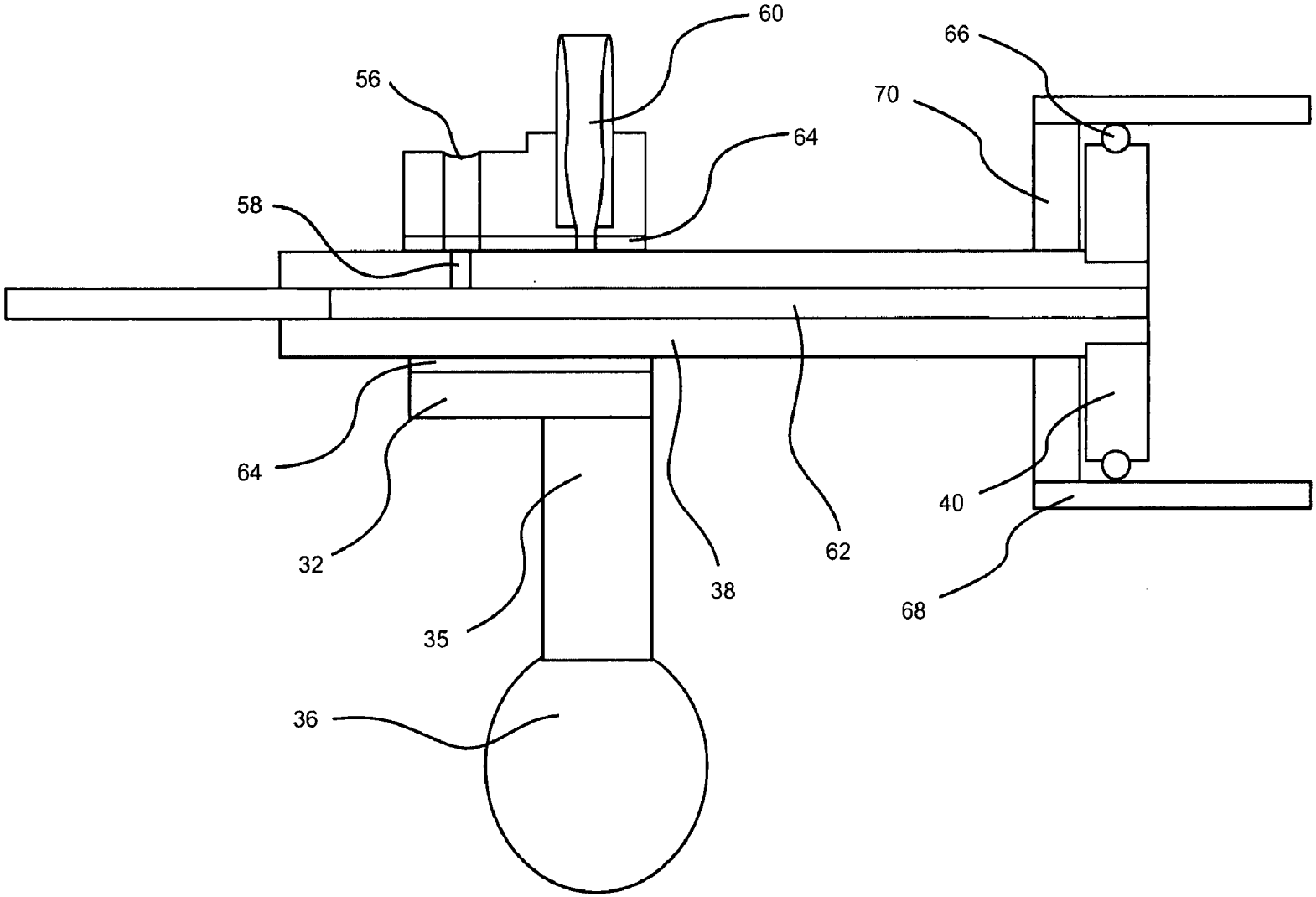

FIG. 3 shows the shuttle valve 32 moved forward to align the shaft port 52 with the exhaust port 56 to allow for the expulsion of the spent gases as the assembly is pushed forward.

FIG. 4 as discussed above shows the shuttle valve rotated after the combustion chamber has been filled to block off ports 56 and 60 from piston port 58.

Figure 5:
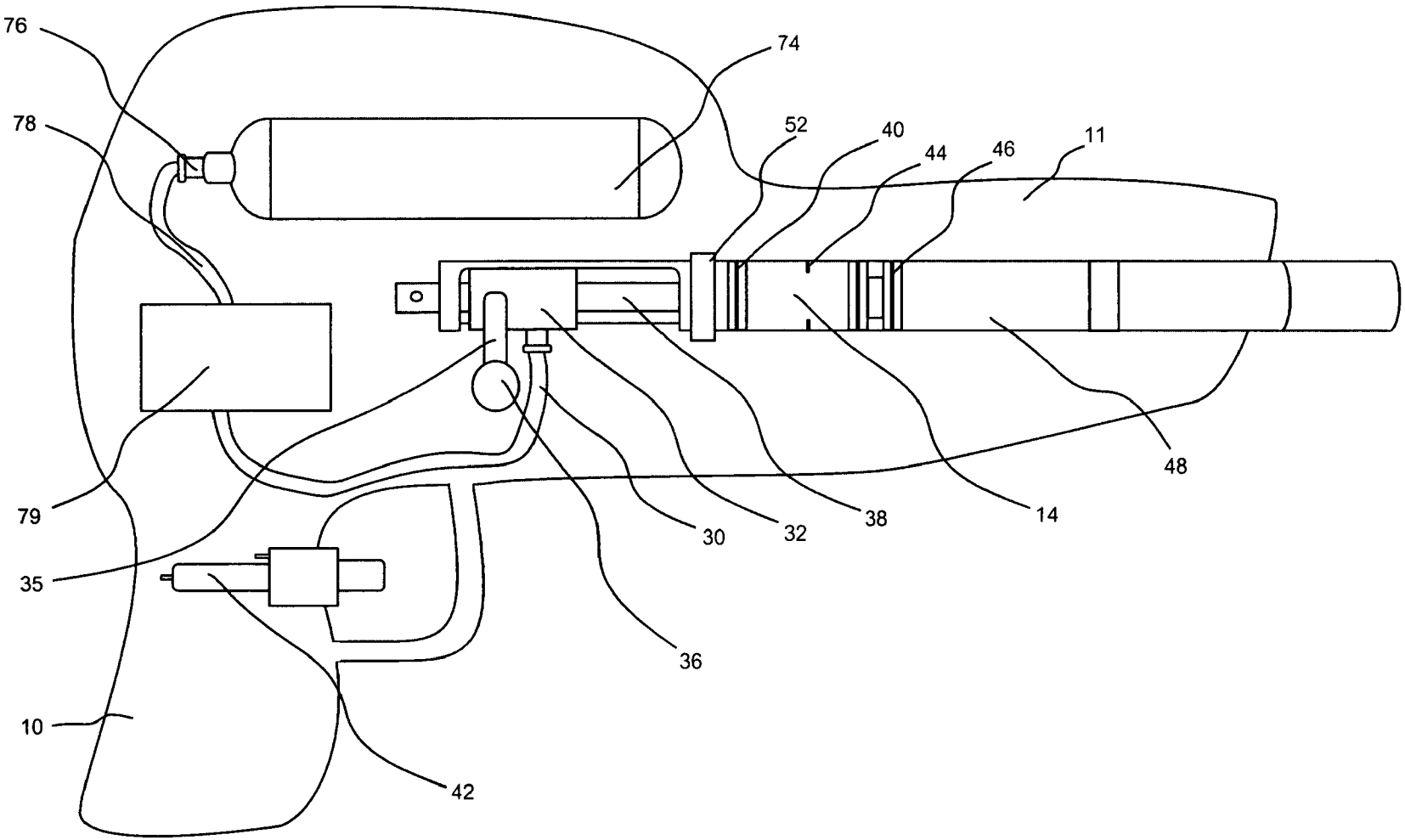

In FIG. 5, the generation equipment is replaced with a hydrogen storage vessel 74 which supplies hydrogen gas through a quick connect fitting 76 to high pressure transfer hose 78 which provides hydrogen to regulator 79 to allow for low pressure hydrogen to fuel supply hose 30. In this configuration, allowances would need to be made for the introduction of ambient air to create a combustible mixture. This arrangement allows for a lighter weight launcher as well as the elimination of any batteries. Although it is not shown, an oxygen tank could be provided to boost the power output of the launcher by allowing for more hydrogen to be used.

Figure 6:
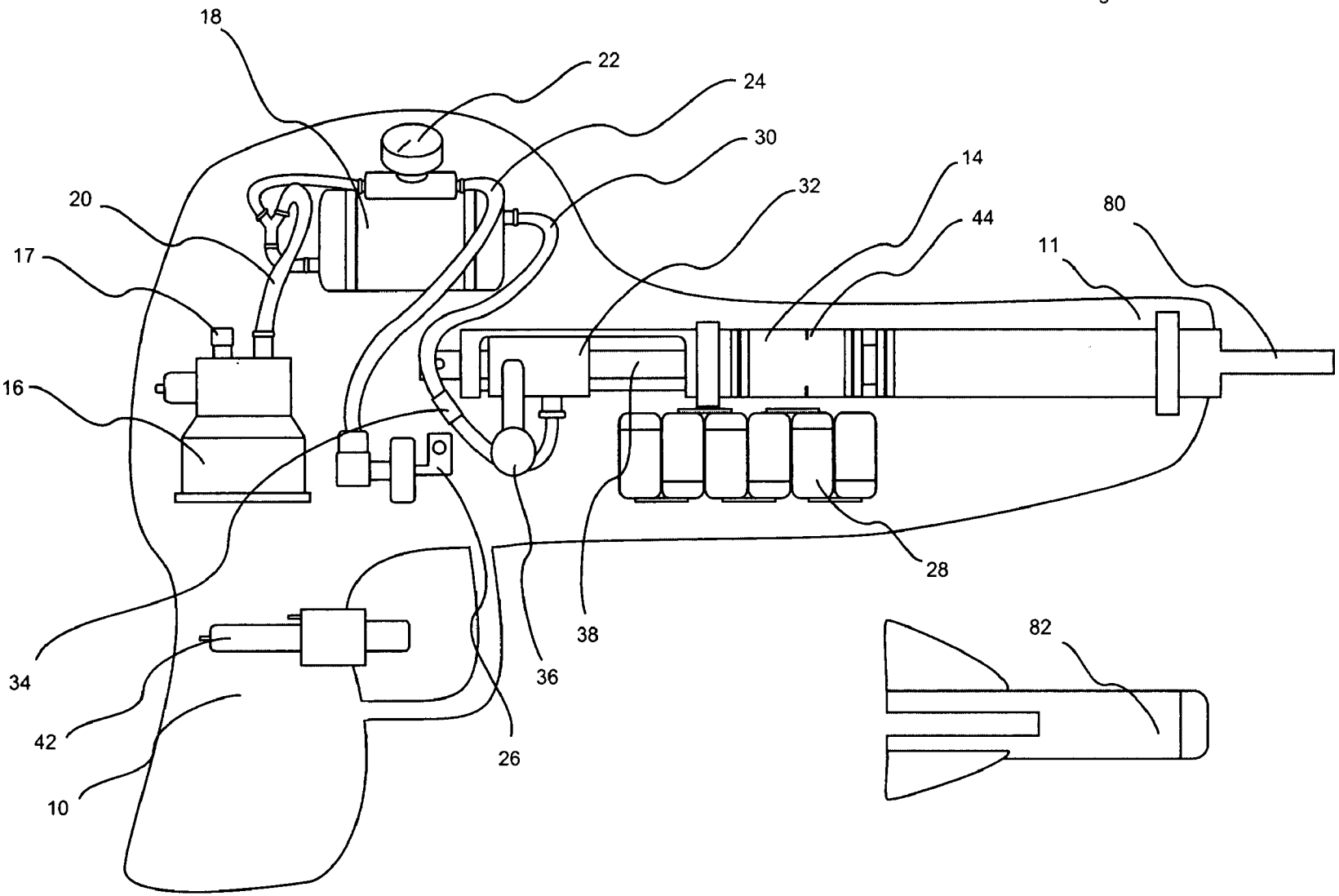

FIG. 6 shows the launcher with the holder 50 replaced by a dart guide 80 to be used in conjunction with dart 82. It should be noted that the dart 82 could be made of a flexible material such as foam. The launcher could be modified to shoot at targets and also modified to shoot bbs or pellets.

Figure 7:
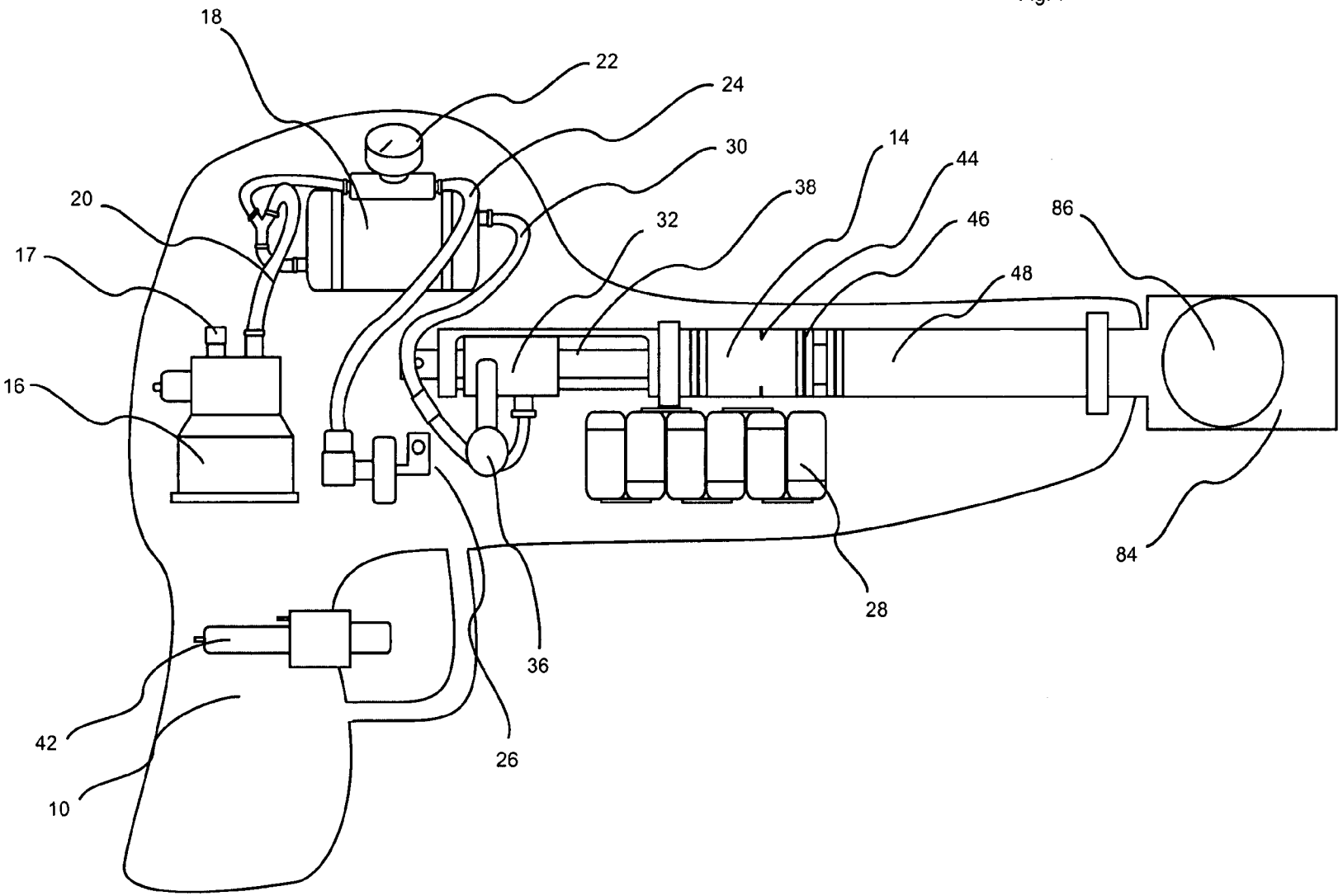

FIG. 7 shows the launcher with the holder 50 replaced by a resilient ball holder 84 to be used in conjunction with resilient ball 86. The ball holder could hold a supply of paint balls for rapid fire shooting.

Figure 8:
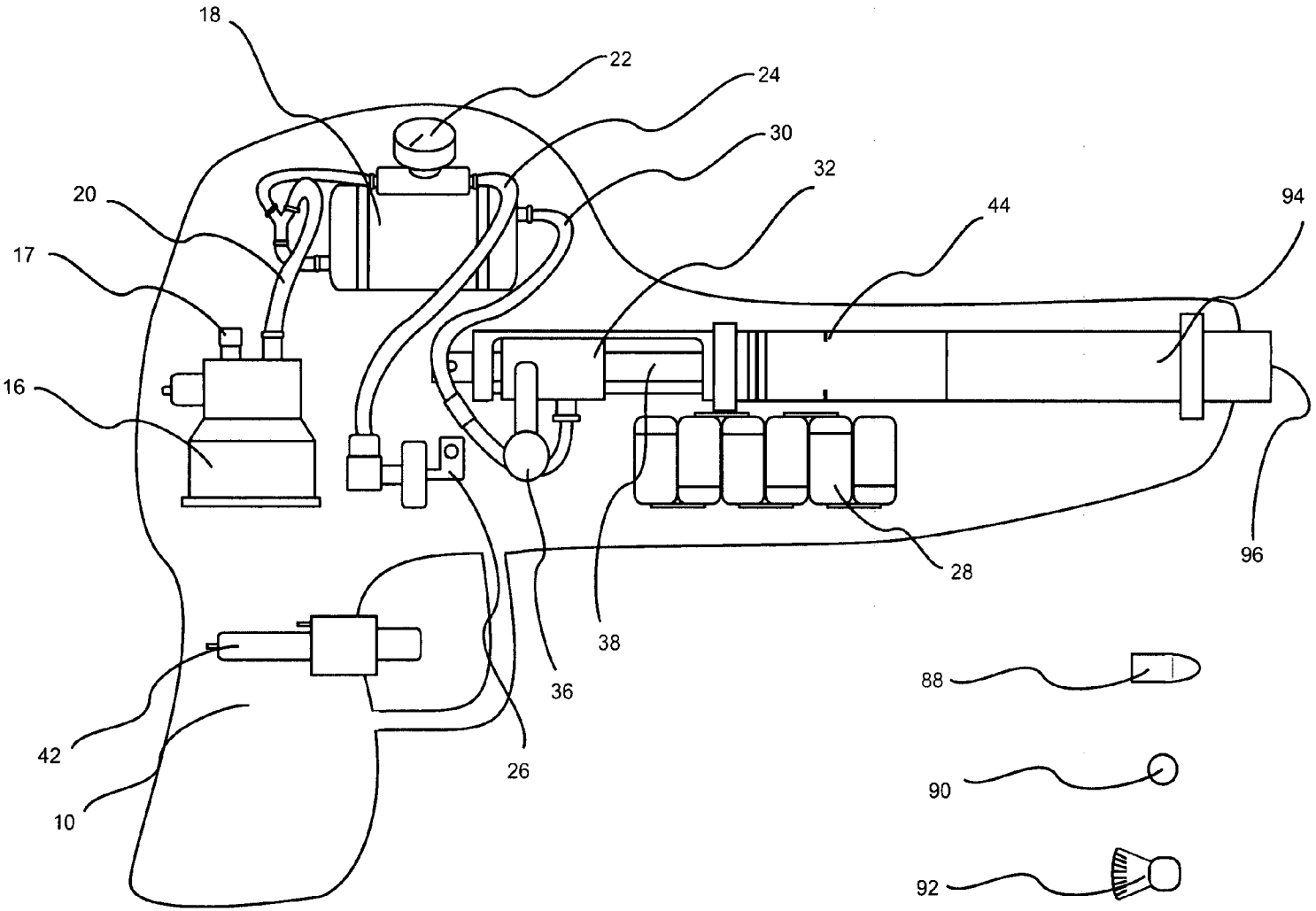

FIG. 8 shows a direct acting launcher system where the expanding combustion gases in combustion chamber 14 acts upon projectiles 88, 90, 92 in conjunction with barrel 94 through bore 96 in barrel 94. This configuration is used for sport target practice to reduce the cost associated with these practices. The bore 96 would be appropriately sized for each type of projectile. The bore 96 could also have radial spiral groves to increase the stability of the projectile as it travels the length of the barrel 94 and exits. Spherical projectile 90 could be constructed of steel or hard plastic. Pellet shaped projectile 92 could be constructed out of lead or flexible plastic. Slug shaped projectile 88 could be constructed out of lead or materials with similar properties. Although we have shown this configuration with these styles of projectiles other styles could be used. And again, although we have shown this configuration as a direct acting system, it could use a secondary piston 46.

It is intended to cover by the appended claims all embodiments that fall within the true spirit and scope of the invention.

The invention claimed is:

1. A projectile launcher apparatus comprising a housing, a barrel in said housing having an open end portion for receiving a projectile having front and rear ends with the front end disposed adjacent the open end of the barrel, a combustion chamber in said housing in communication with the rear end of the projectile, means for supplying hydrogen to said combustion chamber, means for controlling the flow of hydrogen to said combustion chamber and exhaust gases therefrom and means for igniting the hydrogen in said combustion chamber to shoot the projectile out the open end of said barrel with an explosive effect.

2. A projectile launcher apparatus in accordance with claim 1 in which the combustion chamber is located in said barrel in direct communication with said projectile.

3. A projectile launcher apparatus as set forth in claim 1 in which the housing includes a battery powered hydrogen generator for generating hydrogen by the electrolysis of water.

4. A projectile launcher apparatus as set forth in claim 3 in which there is provided a hydrogen storage vessel located between said hydrogen generator and said combustion chamber.

5. A projectile launcher apparatus as set forth in claim 1 in which the means for supplying fuel to the combustion chamber comprises a hydrogen tank in said housing and the means for controlling the flow of hydrogen to said combustion chamber includes a regulator.

6. A projectile launcher apparatus as set forth in claim 1 in which the means for igniting the hydrogen in said combustion chamber comprises electrodes in said combustion chamber and a piezo igniter located in a trigger area defined by said housing.

7. A projectile launcher apparatus in accordance with claim 1 in which the combustion chamber is in the barrel and is formed between a primary piston and a secondary piston whereby when hydrogen is supplied to said combustion chamber and ignited the secondary piston is driven to compress air in the barrel between the secondary piston and projectile to eject the projectile from the barrel.

8. A projectile launcher apparatus as set forth in claim 7 in which the means for controlling the flow of hydrogen to said combustion chamber and exhaust gases from the combustion chamber comprises a slide valve defining a hydrogen inlet conduit and an exhaust gas outlet port which slide valve moves between the inlet conduit to admit hydrogen gas to said combustion chamber and the outlet port to vent the exhaust gases from the combustion chamber after the projectile is expelled from the barrel.

9. A projectile launcher apparatus as set forth in claim 8 in which the primary piston is connected to a hollow shaft interconnecting the combustion chamber and a port defined in said hollow shaft through which the hydrogen and exhaust gases flow when the slide valve is moved between said inlet conduit and outlet ports.

10. A projectile launcher apparatus as set forth in claim 9 wherein there are stop means provided for the secondary piston when the secondary piston is returned to its starting position after the hydrogen in the combustion chamber has been ignited and a vacuum is formed therein.

11. A projectile launcher apparatus as set forth in claim 10 in which there are engaging means between the slide valve and hollow shaft whereby after the hydrogen in the combustion chamber has been ignited the primary piston will be moved forward by the slide valve to facilitate the exhausting of gas from the combustion chamber and when the primary piston is subsequently moved in a rearward direction the combustion chamber is returned to its original configuration to receive hydrogen to be ignited and shoot another projectile.

12. A projectile launcher apparatus as set forth in claim 9 in which the slide valve is rotatably mounted on said hollow shaft to seal off said inlet conduit and outlets ports from said combustion chamber.

13. A projectile launcher apparatus as set forth in claim 1 in which the projectile is slug-shaped.

14. A projectile launcher apparatus as set forth in claim 1 in which the projectile is spherical.

15. A projectile launcher apparatus as set forth in claim 1 in which the projectile is pellet shaped.

16. A projectile launcher apparatus comprising a housing, a barrel in said housing for launching a paint ball for single or rapid fire shooting, a holder for paint balls secured to the end of the barrel, a combustion chamber in said housing in communication with said barrel, means for supplying hydrogen to said combustion chamber, means for controlling the flow of hydrogen to said combustion chamber and exhaust gases therefrom and means for igniting the hydrogen in said combustion chamber to eject the paint ball with an explosive action.

17. A projectile launcher apparatus as set forth in claim 16 in which the ball holder is resilient and is secured to the end of the barrel for holding a resilient ball.

18. A projectile launcher apparatus comprising a housing, a barrel in said housing, a dart guide secured to the end of the barrel for receiving a dart, a combustion chamber in said housing in communication with said barrel, means for supplying hydrogen to said combustion chamber, means for controlling the flow of hydrogen to said combustion chamber and exhaust gases therefrom and means for igniting the hydrogen in said combustion chamber to eject the dart with an explosive action.

* * * * *